US008607725B2

(12) United States Patent
Degirmenci

(10) Patent No.: US 8,607,725 B2
(45) Date of Patent: Dec. 17, 2013

(54) PORTABLE MANUAL SCOREBOARD

(76) Inventor: Oguz Degirmenci, Durham, NC (US)

( * ) Notice: Subject to any disclaimer, the term of this patent is extended or adjusted under 35 U.S.C. 154(b) by 361 days.

(21) Appl. No.: 13/070,532

(22) Filed: Mar. 24, 2011

(65) Prior Publication Data

US 2011/0247545 A1 Oct. 13, 2011

Related U.S. Application Data

(60) Provisional application No. 61/322,135, filed on Apr. 8, 2010.

(51) Int. Cl.
*A63F 1/18* (2006.01)
*A63B 71/06* (2006.01)

(52) U.S. Cl.
USPC ..... 116/222; 40/536

(58) Field of Classification Search
USPC ..... 116/222, 223, 224, 225; 40/536, 617; 235/1 B; 211/58
See application file for complete search history.

(56) References Cited

U.S. PATENT DOCUMENTS

| | | | | | |
|---|---|---|---|---|---|
| 1,709,041 | A | * | 4/1929 | Schutt | 40/536 |
| 3,220,127 | A | * | 11/1965 | Wilson | 40/388 |
| 3,246,411 | A | * | 4/1966 | Aafedt | 116/222 |
| 3,922,805 | A | * | 12/1975 | Krug | 40/533 |
| 4,045,788 | A | * | 8/1977 | Castelli et al. | 340/323 R |
| 4,280,291 | A | * | 7/1981 | Maynes | 40/495 |
| 4,831,956 | A | * | 5/1989 | Thater | 116/222 |
| 5,025,748 | A | * | 6/1991 | Pettis | 116/222 |
| 5,294,913 | A | * | 3/1994 | Mower et al. | 340/323 R |
| 5,615,636 | A | * | 4/1997 | Gustafson | 116/223 |
| D418,431 | S | * | 1/2000 | Niksich | D10/46.1 |
| 6,041,934 | A | * | 3/2000 | Alexson | 206/579 |
| D432,031 | S | * | 10/2000 | Miller et al. | D10/46.1 |
| 7,117,619 | B1 | * | 10/2006 | Huber | 40/495 |
| 2007/0074650 | A1 | * | 4/2007 | Bailey | 116/223 |

FOREIGN PATENT DOCUMENTS

| | | | | | |
|---|---|---|---|---|---|
| DE | 202006009516 | U1 | * | 9/2006 | A63B 71/06 |
| GB | 2215617 | A | * | 9/1989 | A63B 71/06 |
| GB | 2218339 | A | * | 11/1989 | A63B 71/06 |
| JP | 09056866 | A | * | 3/1997 | A63B 71/06 |
| JP | 2005312865 | A | * | 11/2005 | A63B 71/06 |
| JP | 2007021070 | A | * | 2/2007 | A63B 71/06 |
| JP | 3140255 | U | * | 3/2008 | A63B 71/06 |
| JP | 3163223 | U | * | 10/2010 | A63B 71/06 |

* cited by examiner

*Primary Examiner* — R. A. Smith
(74) *Attorney, Agent, or Firm* — Oakwood Law Group, LLP; Yuchien Wei

(57) ABSTRACT

A main board of a manual scoreboard includes recessed areas along the top edge for receiving scoring card hangers, and a holder for a writing instrument. At least one recessed area on the bottom edge of the board is provided for receiving a clamp such as a spring clip to removably attach the manual scoreboard to a support member or, in another embodiment, for receiving support members which hold the scoreboard upright on a flat surface such as a table. A multi-function clip which is removably attached to the main board keeps scoring cards for two teams stable against the wind on both the front and back sides of the main board and is also used to rotatably attach the main board to the spring clip.

15 Claims, 5 Drawing Sheets

PORTABLE MANUAL SCOREBOARD

REFERENCE TO RELATED APPLICATIONS

This patent application claims the benefit of U.S. Provisional Application No. 61/322,135 filed on Apr. 8, 2010, the disclosure of which is incorporated herein by reference in its entirety.

BACKGROUND OF THE INVENTION

1. Field of the Invention

The present invention relates to scoring devices that are portable, self contained, and capable of being used in a wide variety of sporting events.

2. Description of Related Art

Portable scoreboards for keeping score at various games is known in the prior art. More specifically, by way of example, U.S. PreGrant Publication No. 2007/0074650 to Bailey discloses a game scoreboard for displaying game scores of two opponents, which scoreboard comprises front and rear panels with multiple scoring discs mounted on each of the panels, such that the discs may be overlapped to reduce the size of the scoreboard and display game scores on the front side of the discs.

U.S. Pat. No. 7,117,619 to Huber discloses a two-sided, multi-sport scoring banner which sticks and clicks on the board and consisting of a plurality of flexible scoring elements sandwiched between a front face and a back face. A set of scoring symbols on the scoring element allows the score to be displayed through a plurality of windows in the front and back faces of the banner.

U.S. Pat. No. 6,041,934 to Alexson discloses a portable scoring apparatus having a carrying case of two half sections joined together by a flexible connecting section. The two half sections can be open during use and closed during transport. A plurality of scoring elements having numbers are secured to an inside surface of one of the half sections and are pivotable so that they can be supported by the inside surface of the second half section.

U.S. Pat. No. 5,615,636 to Gustafson discloses a portable scoreboard which includes a mounting frame, a leg member having an end attached to the mounting frame, a plurality of cards with scores arranged in two stacks which are aligned along the length of the mounting frame, and a ring member threaded through an apertures in the cards so that they can be rotated for viewing.

U.S. Pat. No. 5,294,913 to Mower discloses a portable electronic scoreboard having a housing with a display face, an electronic mechanism disposed within the housing, and a score registering assembly. The housing back can be attached to a pole or a wall. The score assembly is positioned to detect the passage of a basketball through a basketball goal.

U.S. Pat. No. 5,025,748 to Pettis discloses a portable scoring device which includes a retractable and extendable post section equipped with a ground penetrating tip and a foot brace for driving and anchoring the post section into the ground.

U.S. Pat. No. 4,831,956 to Thater discloses a portable tennis scoring apparatus constructed of a durable fabric which, when unfolded has adequate room for indicating players' names, set, game and point scoring tallies and promotional, organizational or sponsorship information. The tennis scoring apparatus is also large enough to be clearly visible to players and spectators.

U.S. Pat. No. 4,280,291 to Maynes discloses a two-sided portable scoreboard for simultaneously displaying a set of two-digit scores both frontally and rearwardly. A pair of disks is sandwiched between a front and rear plate for each set of scores to be displayed. The disks are axially mounted so that a portion of each overlaps a portion of the other, their centers being positioned so that one is slightly more than a radial distance from the other. Windows are placed in both the front and rear plates to allow a desired sequence of scoring symbols to be viewed there through as the disks are rotated.

U.S. Pat. No. 4,045,788 to Castelli discloses a portable self-contained scoreboard having a plurality of variable numeral displays. Some of the numeral displays are constructed to function as a controllable clock which can count up or count down. The clock numerals can also be manually controlled to indicate other information.

SUMMARY OF THE INVENTION

In an exemplary embodiment of the present invention, there is disclosed a main board of a manual scoreboard includes recessed areas along the top edge for receiving scoring card hangers, a holder for a writing instrument and a lanyard which can be used by the user to hang the scoreboard around his/her neck or anywhere else like a pole or wall. At least one recessed area on the bottom edge of the board is provided for receiving a clamp such as a spring clip to removably attach the manual scoreboard to a support member or, in another embodiment, for receiving support members which hold the scoreboard upright on a flat surface such as a table. A multi-function clip which is removably attached to the main board is used to rotatably attach the main board to the spring clip.

The more important features of the invention have thus been outlined in order that the more detailed description that follows may be better understood and in order that the present contribution to the art may better be appreciated. Additional features of the invention will be described hereinafter and will form the subject matter of the claims that follow.

Before explaining at least one embodiment of the invention in detail, it is to be understood that the invention is not limited in its application to the details of construction and the arrangements of the components set forth in the following description or illustrated in the drawings. The invention is capable of other embodiments and of being practiced and carried out in various ways. Also it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

The foregoing has outlined, rather broadly, the preferred feature of the present invention so that those skilled in the art may better understand the detailed description of the invention that follows. Additional features of the invention will be described hereinafter that form the subject of the claims of the invention. Those skilled in the art should appreciate that they can readily use the disclosed conception and specific embodiment as a basis for designing or modifying other structures for carrying out the same purposes of the present invention and that such other structures do not depart from the spirit and scope of the invention in its broadest form.

BRIEF DESCRIPTION OF THE DRAWINGS

Other aspects, features, and advantages of the present invention will become more fully apparent from the following detailed description, the appended claim, and the accompanying drawings in which similar elements are given similar reference numerals.

DESCRIPTION OF THE PREFERRED EMBODIMENT

There are many local and national sports events all around the USA and the world. For such events, it would be convenient for both the competitors and the spectators to have a device to display and keep the score. Otherwise, the referee has to say it loudly at every update, and it is uncomfortable for the referee as well as the spectators who wish to keep track of the score. Forgetting the score or making an error disrupts the flow of the game. In most local tournaments in the USA, competitors take turns in refereeing the games, e.g. after the end of a match, one of the players will referee the next match that his/her team does not participate in. While refereeing, they either just keep the score in their mind or use a sheet of paper on clipboard to record it. Without a device to display the score, it is difficult for the refereeing players to call the points every time a team gets one, so they usually do not announce every update of the score. Therefore, when they make a mistake, it usually goes unnoticed by the players and spectators for 5-6 more rallies when it is first noticed. Correcting the mistake and finding the right score is much harder after 5-6 more points have been obtained and the error may lead to a dispute between the teams and the referee.

With the score board here disclosed, if the referee makes a mistake, players and spectators can immediately see it and inform the referee before it is too late.

Having only one referee is common for amateur level tournaments. In such cases, the referee cannot operate a large scoreboard and referee a game at the same time. With the mobile scoreboard here disclosed a person can both referee a match and display the score.

The referees at most outdoor tournaments such as beach and grass volleyball events usually keep the score while sitting on a beach chair. The mobile scoreboard here disclosed can be attached to the arm of a beach chair or a table. Moreover, if the referee chooses to stand, he/she can easily hang the score board either on a pole or around his/her neck.

Figure 1:
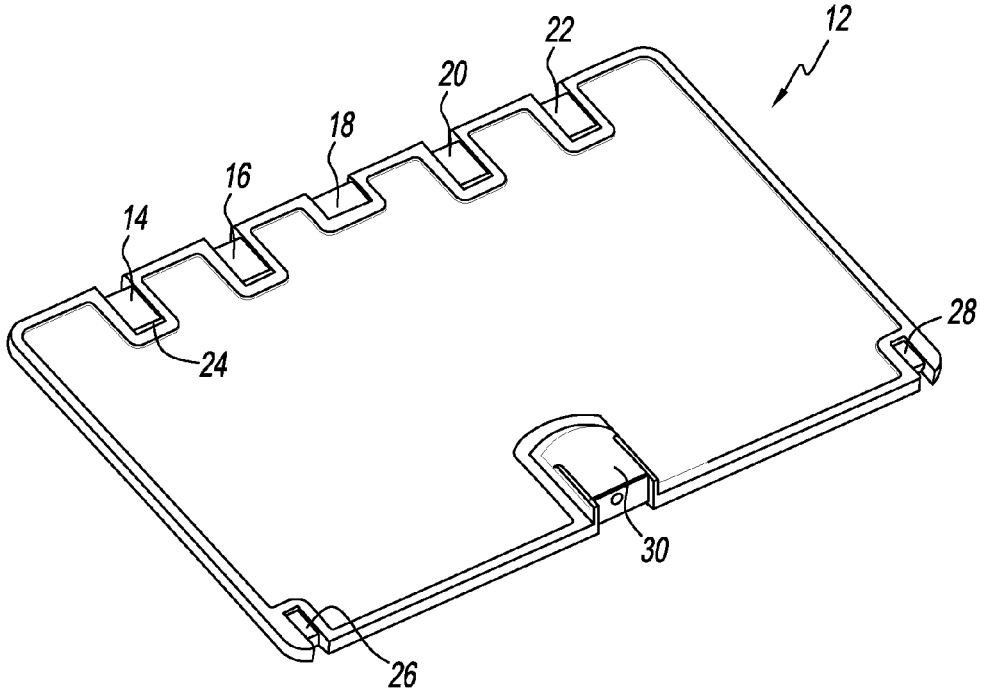
FIG. 1 is a side perspective view of the main board of a manual scoreboard showing recessed areas along the top edge for receiving scoring card hangers in addition to a holder for a writing instrument and at least one recessed area on the bottom edge for receiving a clamp for removably attaching the manual scoreboard to a support member or support members for holding the scoreboard upright on a flat surface such as a table.

Referring to FIG. 1, there is shown a side perspective view of the main board 12 of a manual scoreboard having recessed areas along the top and bottom edges. The recesses at the top of the board are for receiving scoring card hangers and a holder for a writing instrument and a lanyard which can be used by the user to hang the scoreboard around his/her neck or anywhere else like a pole or wall. The recessed areas at the bottom edge are for receiving either a spring clamp which is used to removably attach the manual scoreboard to a support member or for support members for holding the scoreboard upright on a flat surface such as a table.

The main board is composed of a water proof material such as a rigid or semi-rigid plastic or of fiber glass which may have a height of about five inches, more or less, a width of about seven inches, more or less and a thickness of between three sixteenth of an inch and three eighths of an inch, more or less, it being understood that the main board is not restricted to these dimensions but can have dimensions which are greater than the dimensions noted. Located along the top edge of the main board are five recessed areas 14, 16, 18, 20 and 22. The first pair of recessed areas 14, 16 are provided for receiving two scoring card hangers which hold the scoring cards of a first team, and the second pair of recessed areas 20, 22 are provided for receiving two scoring card hangers which hold the scoring cards of a second team. Recessed area 18 is for receiving a holder for a writing instrument such as a pen which can be used for recording game details on paper located on the board and a lanyard which can be used by the user to hang the scoreboard around his/her neck or anywhere else like a pole or wall.

Each recessed area 14, 16, 20, and 22 has a web member with a width of about three eighths of an inch, a height of about one inch, more or less, and a thickness of between one sixteenth and five sixteenth of an inch, more or less. The top of each web member is located about one eighth of an inch below the top edge of the main board. A ridge 24 which extends across the web member and is located just above the bottom of the web member is provided to allow scoring card hangers to more positively engage the main board. Recessed areas 14, 22 are located about three quarters of an inch in from the side edges of the main board and the spacing between adjacent recessed areas is about seven eighths of an inch, more or less.

Figure 2:
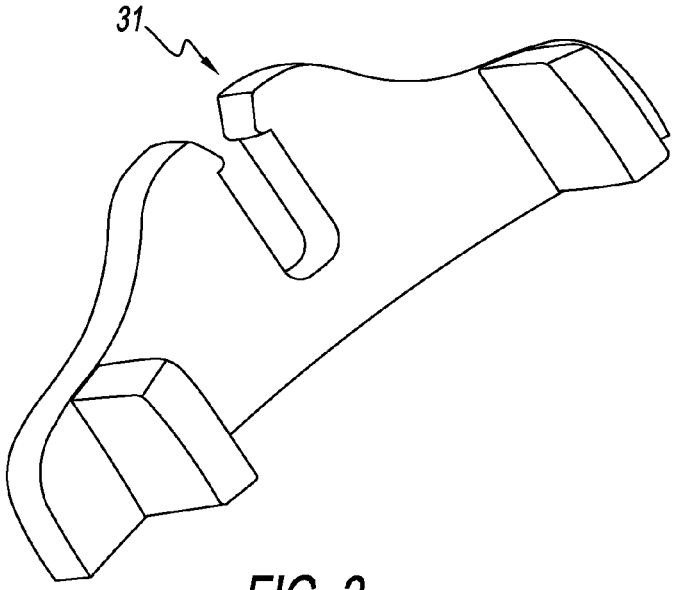
FIG. 2 is a side perspective view of one of two support members.

Three recessed areas 26, 28 and 30 are located along the bottom edge of the main board. Recessed areas 26, 28 are provided for receiving support members which are used to hold the scoreboard upright on a flat surface such as a table and, in addition, the support members can be used to keep scoring cards against the scoreboard during windy conditions. See FIG. 2 which is a side perspective view of one of two support members 31. Recessed area 30 is provided for a multi-function clip 32 which is centrally located between sets of scoring cards and is provided to keep the scoring cards on the front and back of the main board stable during windy days. Except for size, the recessed areas 26, 28 are similar to recessed areas 14, 16, 20, 22; and recessed area 30 is similar to recessed area 18.

Figure 3:
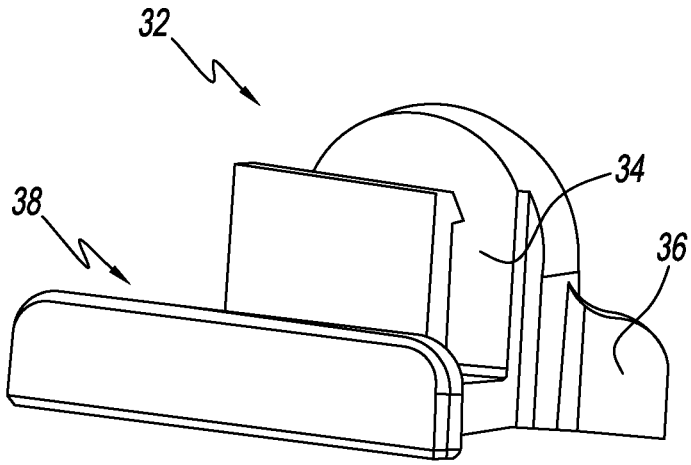
FIG. 3 is a perspective rear view of a multi-function clip which can be removably attached to the main board to keep scoring cards stable against the wind on both the front and back side of the main board, to attach the main board to a spring clip.

Referring to FIG. 3, there is shown a rear perspective view of the multi-function clip 32 which is removably attached to the recessed area 30 of the main board. Clip 32 includes a slot 34 which is adapted to receive and securely grasp the web of recessed area 30. When attached to the main board 12, two wings 36 at the front of the clip keep scoring cards of opposing teams on the front of the main board stable during windy days, and a channel 38 at the rear of the clip keeps the scoring cards of opposing teams on the rear of the main board stable during windy days. The multi-function clip has a cylindrical shaped opening (not shown) which extends up from its bottom surface for rotatably receiving a support rod which is located on the spring clip of FIGS. 4 and 5.

Figure 4:
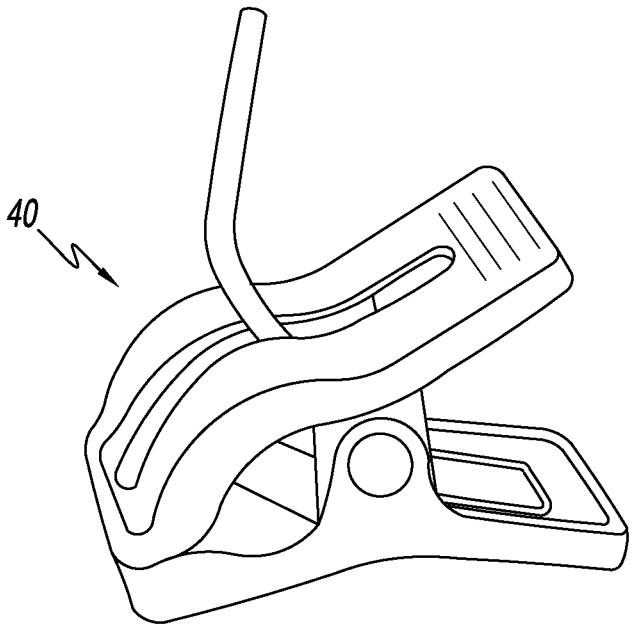
FIG. 4 is a perspective side view of a spring clamp for removably attaching the manual scoreboard to a support member.
Figure 5:
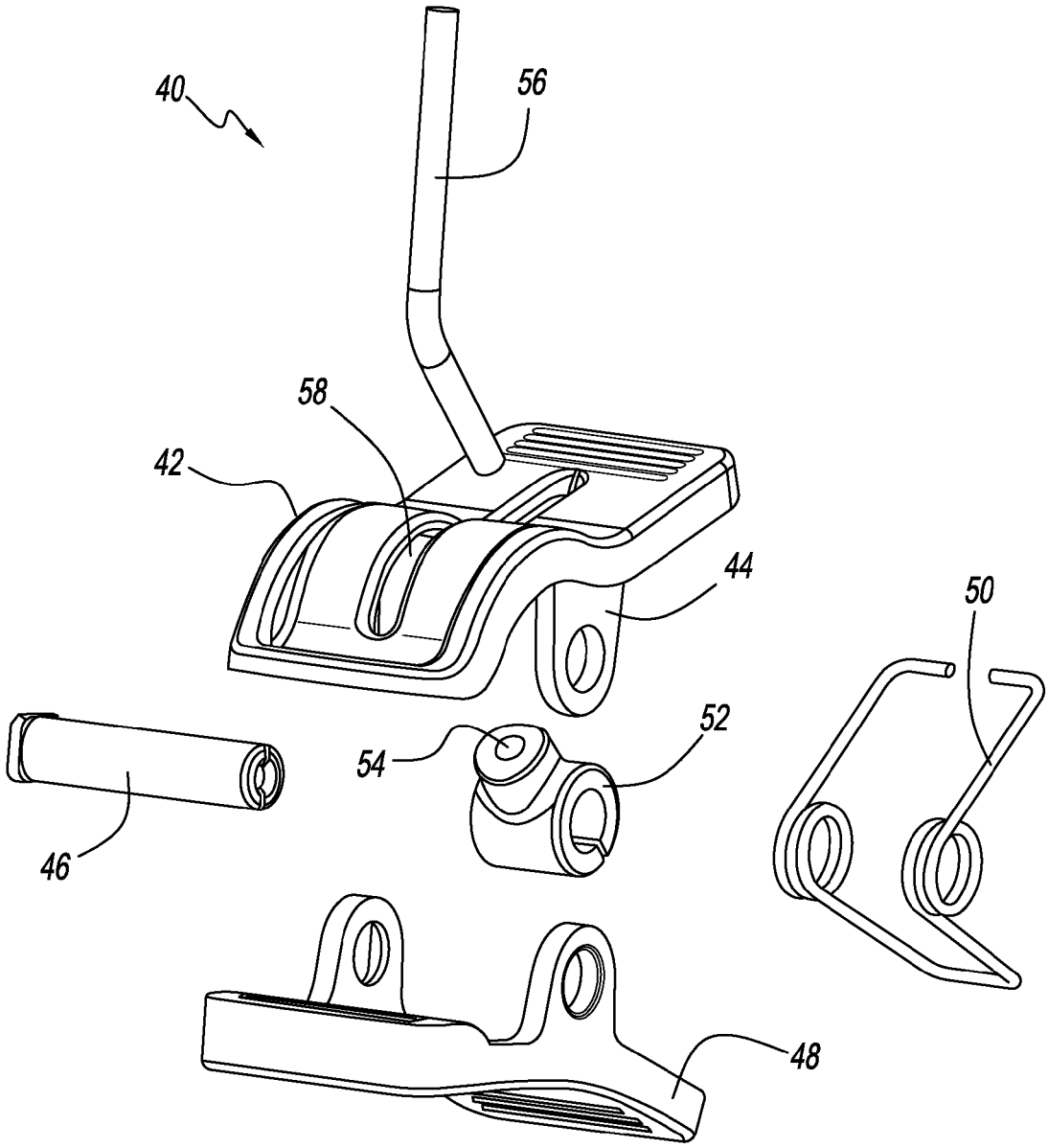
FIG. 5 is an exploded view of the spring clamp of FIG. 4.

Referring to FIGS. 4 and 5, there is shown a perspective view and an exploded view of the spring clamp 40 for removably and rotatably attaching the manual scoreboard to a support member. Spring clamp 40 includes an upper jaw 42 having an arm 44 which is rotatably connected via a shaft 46 to a lower jaw 48. A spring 50 which is coupled to the shaft 46 urges the clamp to its closed position. A bushing 52 which is frictionally and rotatably coupled to the shaft 46 has an opening 54 which receives a shaft 56 that extends through a slot 58 in the upper jaw 42 and is provided to be located in the cylindrical shaped opening in the bottom of the multi-function clip.

In use, when the multi-function clip 40 is attached to the main board 12, the score board can be attached to a convenient support such as a table, beach chair, fence, pole, etc., and the scoreboard can be rotated to face in any direction. The spring clamp allows the scoreboard to be used where there are no tables or table referees at the courts and the referees either stand behind the pole or sit on a beach chair, such as at a beach volleyball tournament. The scoreboard can easily be clamped onto a clipboard if the user likes to use a clip board while refereeing. The connecting rod 56 on the spring clamp allows the user to rotate the scoreboard to face in any direction.

Figure 6:
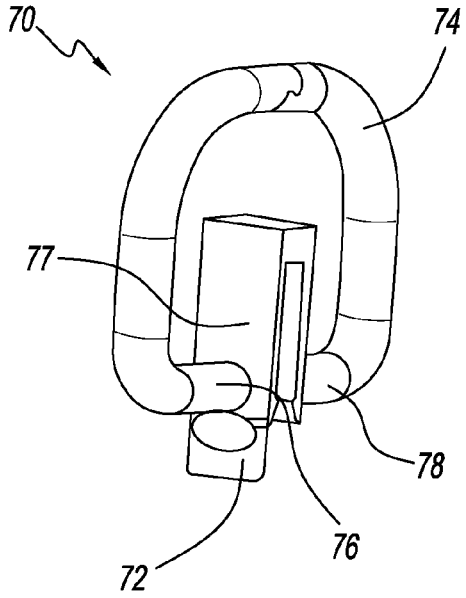
FIG. 6 is a perspective view of a scoring card hanger.
Figure 7:
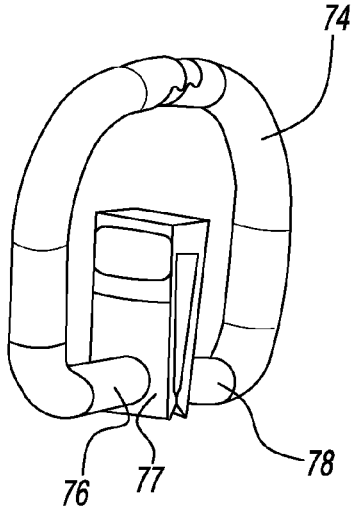
FIG. 7 is a perspective view of another type of scoring card hanger.

Referring to FIGS. 6 and 7, there is shown perspective views of two types of scoring card hangers. One type of scoring card hanger 70, see FIG. 6, has a longer leg 72 in order to hold a match sheet on the main board for showing the game details. Each scoring card hanger has a C shaped member 74 of a circular cross section where one end 76 of the C shaped member is attached to a rear leg 72,77 and the other end 78 of the C shaped member is attached to the front leg. Except for the longer leg 72, the two scoring card hangers are similar and can be a single part made from a single mold. The top part of the scoring sheets are clamped to the main board be being squeezed between the longer rear leg of the C shaped member and the main board.

The space between the end 78 of the C shaped member and the front leg, as well as the space between the end and the rear leg, allows scoring cards that are placed on the member to be removed along the C shaped member, so that the card can be flipped from front to back and vice versa, and the rounded top of the C shaped member allows the scoring cards to be flipped over easily while the flat bottom of the C shaped member keeps the scoring cards even. The C shaped member 74 can be disconnected from the point where the front end of the C shaped member meets the front leg of the card hanger via pulling the front end of the C shaped member outward, which allows the scoring cards to be installed and removed. The hangers, which are removably attached to the recessed areas on the main board can be easily replaced if broken.

Figure 8:
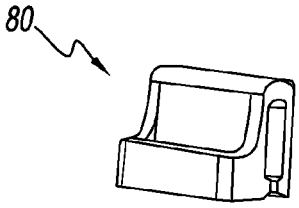
FIG. 8 is a perspective view of a holder which can be removably attached to the scoreboard for receiving a writing instrument.

Referring to FIG. 8, there is shown a perspective view of a holder 80 for a writing instrument which is adapted to be removably attached to the scoreboard. The holder is removably attached to the recess area 18 at the top center of the main board to allow a user to store a writing instrument such as a pen which can be used for recording game details on paper located on the scoreboard and to hold a lanyard which can be used by the user to hang the scoreboard around his/her neck or anywhere else like a pole or wall. Players usually tend to lose the pen, especially at outdoor tournaments. This feature will solve that problem. The holder can also be used as a lanyard connection when a user wants to hang the scoreboard around his/her neck to keep their hands free. Amateur tournaments normally have one referee standing at the side of the court to referee the match. With the scoreboard here disclosed he/she can stand and referee the game, use his/her whistle and hand signals and then change the score on the scoreboard.

Figure 9:
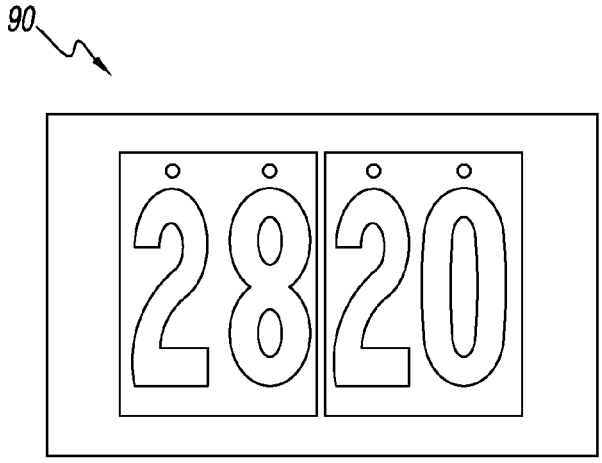
FIG. 9 is a front view of two double sided scoring cards of different colors which can be used with the manual scoreboard to keep score during a game.

Referring to FIG. 9, there is shown a front view of two double sided scoring cards 90 of different colors which can be used with the manual scoreboard to keep score during a game. There are two sets of double sided scoring cards, one set can be red and the other set can be blue. The scoring cards are waterproof and each card has two circular openings for hanging on the C shaped members 74 of the card hangers 70 when attached to the main board. The scoring cards are for ongoing game scoring. Each set is for a specific team to indicate the teams score. The scoring cards are about two and three quarters of an inch wide, more or less, and about four and one quarter inches high, more or less, and the numbers on the cards are as large as the scoring cards.

Figure 10:
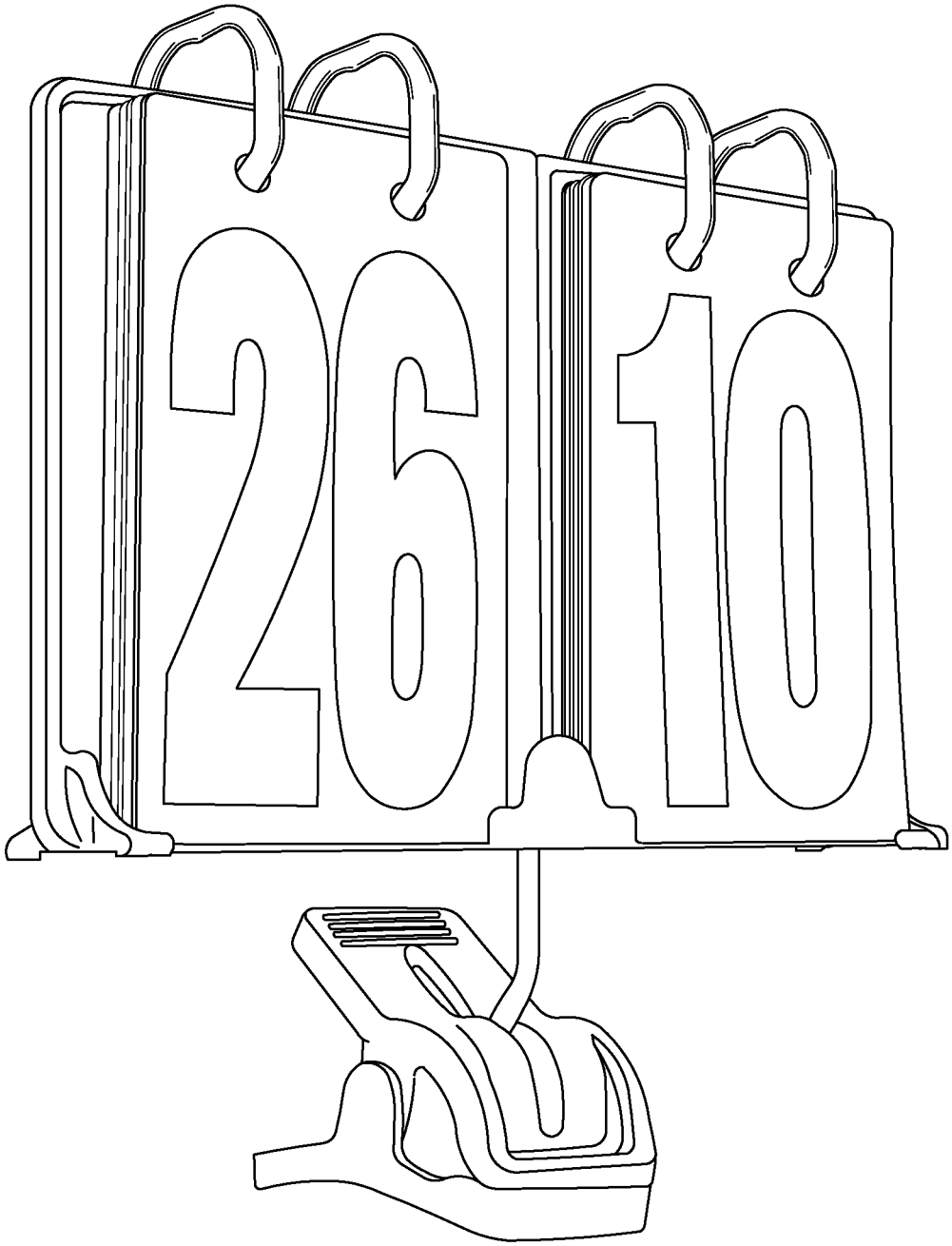
FIG. 10 is a perspective view of the assembled manual scoreboard showing two double sided scoring cards of different colors for keeping score during a game located on the main board which is attached to the shaft of the spring clamp.

Referring to FIG. 10, there is shown a perspective view of the assembled manual scoreboard with two double sided scoring cards of different colors, one for each team, for keeping score during a game. The cards are located on the main board which is attached to the shaft of the spring clamp which allows the manual scoreboard to be removably attached to a support member.

While there have been shown and described and pointed out the fundamental novel features of the invention as applied to the preferred embodiments, it will be understood that the foregoing is considered as illustrative only of the principles of the invention and not intended to be exhaustive or to limit the invention to the precise forms disclosed. Obvious modifications or variations are possible in light of the above teachings. The embodiments discussed were chosen and described to provide the best illustration of the principles of the invention and its practical application to enable one of ordinary skill in the art to utilize the invention in various embodiments and with various modifications as are suited to the particular use contemplated All such modifications and variations are within the scope of the invention as determined by the appended claims when interpreted in accordance with the breadth to which they are entitled.

What is claimed is:

1. A portable scoreboard comprising:

a main board;

a first pair of card hangers for holding scoring cards of a first team;

a second pair of card hangers for holding scoring cards of a second team;

a first pair of recessed areas having a web located at a top edge of the main board for receiving the first pair of card hangers;

a second pair of recessed areas having a web located at the top edge of the main board for receiving the second pair of card hangers;

a recessed area having a web centrally located at a bottom edge of the main board for receiving a multi-functional clip;

a recessed area having a web located at a side end of the bottom edge of the main board for receiving a support member; and a recessed area having a web located at the other side end of the bottom edge of the main board for receiving another support member.

2. The portable scoreboard of claim 1 wherein the multi-function clip is used for keeping scoring cards stable against the wind and for attaching the main board to a clamp.

3. The portable scoreboard of claim 2 wherein the clamp is attached to the multi-function clip for attaching the main board to a support surface.

4. The portable scoreboard of claim 3 wherein the clamp is a spring clamp.

5. The portable scoreboard of claim 3 wherein the clamp is rotatably connected to the main board.

6. The portable scoreboard of claim 3 wherein the clamp is removably connected to the main board.

7. The portable scoreboard of claim 1 wherein each scoring card hanger has a clamp with a front leg that faces the front of the scoreboard and a rear leg that faces the rear of the scoreboard, and a C shaped member wherein one end of the C shaped member is attached to the front leg and the other end of the C shaped member is attached to the rear leg.

8. The portable scoreboard of claim 7 wherein the rear leg is longer than the front leg to hold a match sheet showing game details.

9. The portable scoreboard of claim 7 further comprising a recessed area having a web centrally located at the top edge of the main board for removably receiving a holder for a writing instrument.

10. The portable scoreboard of claim 9 wherein the scoring cards held by the first pair of card hangers for a first team are different than the scoring cards held by the second pair of card hangers for the second team.

11. The portable scoreboard of claim 1 wherein the support members are used for holding the scoreboard upright on a flat surface such as a table and to hold scoring cards on the score board against the wind.

12. The portable scoreboard of claim 11 wherein each scoring card hanger has a clamp with a front leg that faces the front of the scoreboard and a rear leg that faces the rear of the scoreboard and a C shaped member which can be disconnected from the front leg of the card hanger via pulling its front end outward wherein the rear end of the C shaped member is attached to the rear leg and the front end of the C shaped member is clicked to the front leg; and scoring cards can be installed or removed through a connecting point of the front end of the C shaped member and the front leg of the card hanger by pulling the front end of the C shaped member outward.

13. The portable scoreboard of claim 12 wherein the top part of the C shaped member is rounded to allow scoring cards to be flipped over easily from one side of the scoreboard to the other.

14. The portable scoreboard of claim 13 wherein the bottom sections of the C shaped member are straight to allow scoring cards to be even.

15. The portable scoreboard of claim 12 wherein the rear leg is longer than the front leg to hold a match sheet showing game details.

* * * * *